US007206727B2

(12) United States Patent
Klauder, Jr.

(10) Patent No.: US 7,206,727 B2
(45) Date of Patent: Apr. 17, 2007

(54) METHOD FOR DESIGNING GENERALIZED SPIRALS, BENDS, JOGS, AND WIGGLES FOR RAILROAD TRACKS AND VEHICLE GUIDEWAYS

(76) Inventor: Louis T. Klauder, Jr., 527 Park Ave., Quarryville, PA (US) 17566

( * ) Notice: Subject to any disclaimer, the term of this patent is extended or adjusted under 35 U.S.C. 154(b) by 0 days.

(21) Appl. No.: 10/506,708

(22) PCT Filed: Mar. 28, 2003
(86) PCT No.: PCT/US03/09667

§ 371 (c)(1),
(2), (4) Date: Sep. 7, 2004

(87) PCT Pub. No.: WO03/083214
PCT Pub. Date: Oct. 9, 2003

(65) Prior Publication Data

US 2005/0159933 A1 Jul. 21, 2005
US 2007/0027661 A9 Feb. 1, 2007

Related U.S. Application Data

(63) Continuation-in-part of application No. 10/311,613, filed as application No. PCT/US01/41074 on Jun. 20, 2001.

(60) Provisional application No. 60/391,638, filed on Jun. 27, 2002, provisional application No. 60/388,859, filed on Jun. 17, 2002, provisional application No. 60/371,842, filed on Apr. 11, 2002, provisional application No. 60/368,952, filed on Mar. 29, 2002, provisional application No. 60/294,288, filed on May 31, 2001, provisional application No. 60/292,037, filed on May 21, 2001, provisional application No. 60/212,499, filed on Jun. 20, 2000.

(51) Int. Cl.
*G06F 17/10* (2006.01)

(52) U.S. Cl. ..... 703/2; 703/7; 701/19; 104/7.1; 238/15

(58) Field of Classification Search ..... 703/2, 703/7; 104/7.1, 7.2, 164, 189; 701/19; 238/15
See application file for complete search history.

(56) References Cited

U.S. PATENT DOCUMENTS 3,732,827 A 5/1973 Anderson (Continued)

FOREIGN PATENT DOCUMENTS

WO WO0198938 12/2001
WO WO05104789 11/2005

OTHER PUBLICATIONS

Abramowitz, Milton, et al., *Handbook of Mathematical Functions*, National Bureau of Standards, Applied Mathematics Series 55, pp. 773 to 775, U.S. Gov. Printing Office, Washington, D.C. (1964).

(Continued)

*Primary Examiner*—Russell Frejd
(74) *Attorney, Agent, or Firm*—Gary M. Cohen

(57) ABSTRACT

A prior method for designing transition curves for railroad tracks and other vehicle guideways begin with a choice of a roll function representing a functional form for variation of the track or guideway roll or cant angle as a function of distance and requires the curvature of the transition shape to keep the components of centripetal and gravitational acceleration in the plane of the track or guideway equal at each point along the shape and integrates the equation expressing that equality as part of a procedure for determining the resulting transition curve shape. That method is supplemented by a method of defining basic roll functions in terms of Gegenbauer orthogonal polynomials, including roll functions which generate simple spirals as well as more complex shapes (referred to as bends, jogs, and wiggles). Roll functions for the various shapes are defined as weighted sums of the basic roll functions, and can generate transition curve shapes that have good dynamic characteristics and that are more general than the shapes that can be constructed using the prior method. A resulting generalized spiral can be used to compensate for inadequate offset when a spiral needs to be lengthened for operation at higher speed or to realign an existing spiral whose shape has become so different from its original design shape that restoration to that shape would be impractical.

17 Claims, 3 Drawing Sheets

U.S. PATENT DOCUMENTS

| | | | |
|---|---|---|---|
| 3,905,568 | A | 9/1975 | Watanabe et al. |
| 3,939,777 | A | 2/1976 | Moran |
| 4,323,013 | A | 4/1982 | Theurer |
| 4,693,183 | A | 9/1987 | Pötzsch |
| 4,860,666 | A | 8/1989 | Smith |
| 5,012,413 | A | 4/1991 | Sroka et al. |
| 5,791,254 | A | 8/1998 | Mares et al. |
| 5,988,519 | A | 11/1999 | Jordie |
| 6,257,494 | B1 | 7/2001 | Tokuoka et al. |
| 6,347,265 | B1 | 2/2002 | Bidaud |
| 2001/0010197 | A1 | 8/2001 | Kassab |

OTHER PUBLICATIONS

Ahmadian, Mehdi, "Filtering Effects of Mid-Cord Offset Measurements on Track Geometry Data", Proceedings of the 1999 ASME/IEEE Joint Railroad Conference, pp. 157-161 (1999).

Baluch, Henryk, "Optimation of Transition Length Increase", Rail International, Oct. 1982, pp. 12 to 19.

Kufver, Björn, VTI Report 420A, "Mathematical Description of Railway Alignments and Some Preliminary Comparative Studies", Swedish National Road and Transport Research Institute (1997), pp. 1-4, 9-12 and 41-60.

Presle, Gërard, et al., "Entwicklung und Grundlagen neuer Gleisgeometrie", ZEV+DET Glas. Ann. 122 (1998) 9/10, Sep./Oct., pp. 579-586.

Belzer, J., "Geometrics of Spiral Bridge Design", 13th National Meeting of the Association for Computing Machinery, pp. 13-1 to 13-3 (Jun. 1958).

Clark, R., "Rail Flaw Detection: Overview and Needs for Future Developments", NDT & E International, vol. 37, No. 2, Mar. 2004, pp. 111-116.

Klauder, Louis T., Jr., "The Right Way to Design Track Curve Transition Spirals—Improved Spiral Geometry for High Speed Rail", Annual Conference of the American Railway Engineering and Maintenance of Way Association (AREMA), Dallas, Texas (Sep. 11 to 13, 2000).

Krueger, H., et al., "Simulation Within the Railroad Environment", Proceedings of the 32nd Conference on Winter Simulation, pp. 1191-1200 (Dec. 2000).

Steenblik, R.A., et al., "Numerical Modeling of the Conformational Transition of a Spiral Focusing Surface", ACM SIGSIM Simulation Digest, Proceedings of the 23rd Annual Symposium on Simulation, pp. 127-134 (Apr. 1990).

METHOD FOR DESIGNING GENERALIZED SPIRALS, BENDS, JOGS, AND WIGGLES FOR RAILROAD TRACKS AND VEHICLE GUIDEWAYS

CROSS-REFERENCE TO RELATED APPLICATIONS

This application claims the benefit of U.S. Provisional Application No. 60/368,952, filed Mar. 29, 2002; U.S. Provisional Application No. 60/371,842, filed Apr. 11, 2002; U.S. Provisional Application No. 60/388,859, filed Jun. 17, 2002; and. U.S. Provisional Application No. 60/391,638, filed Jun. 27, 2002. This application is also a continuation-in-part of U.S. patent application Ser. No. 10/311,613, which has an assigned filing date of Dec. 17, 2002, which was the National Stage of International Application No. PCT/US01/41074, filed Jun. 20, 2001, which claims the benefit of U.S. Provisional Application No. 60/212,499, filed Jun. 20, 2000; U.S. Provisional Application No. 60/292,037, filed May 21, 2001; and U.S. Provisional Application No. 60/294,288, filed May 31, 2001, and which has since issued as U.S. Pat. No. 7,027,966 on April 11, 2006.

BACKGROUND OF THE INVENTION

In the field of geometrical layout for railroad tracks the traditional elements have been the straight line (with constant curvature equal to zero), the circular arc (with curvature that is constant but not zero), and the spiral (along whose length the curvature varies monotonically). When two sections of track that have different constant values of curvature would otherwise meet one another it is normal (with exceptions in some special cases) for the two sections to be connected by a spiral whose curvature and compass bearing at each end matches those of the adjacent section to which that end connects. Spirals have traditionally been conceived as geometrical shapes on the ground, and a number of specific shapes have been devised and applied during the past two centuries.

A method for the design of railroad track spirals, and a number of specific shapes that can be obtained using this method, are described in International Application No. PCT/US01/41074 by Louis T. Klauder, Jr., titled "Railroad Curve Transition Spiral Design Method Based on Control of Vehicle Banking Motion" (hereafter referred to as the "KS_Method"). The KS_Method looks at a spiral not first of all as a shape but rather as means of helping the guided vehicles change their roll or bank angle from the value appropriate for getting gravity to provide centripetal acceleration in one section to the value appropriate for that purpose in a following section whose centripetal acceleration is different.

The following introduces some terminology that is helpful for describing the general field of track and guideway geometry, the KS_Method, and the methods of the current invention. Let the speed of travel be denoted as v, and denote compass bearing of the track as a function of distance s along the track by b(s). The curvature is defined as the first derivative of the bearing with respect to distance, which is denoted as db(s)/ds. The component of centripetal acceleration in the plane of the track will be provided by gravity if the equation $$v^2 db(s)/ds \cos(r(s)) = g \sin(r(s)) \quad (1)$$

is satisfied, where g is the acceleration of gravity, r(s) is the function that specifies the roll or bank angle of the track as a function of distance s, and cos and sin are the common trigonometry functions. Hereafter, the forgoing equation is referred to as the "balance equation", and v is referred to as the "balance speed".

In the KS_Method for designing a spiral the first task is to choose a functional form for r(s) within the length of the spiral. The subsequent tasks are: to integrate the balance equation to obtain the compass bearing b(s), to integrate cos(b(s)) and sin(b(s)) to obtain respectively the x and y coordinates of points along the spiral, and to identify the parameters of the function r(s) for which the resulting shape properly connects to the adjacent sections of constant curvature track, incorporating the forgoing two stages of integration into an iterative search for that purpose if need be. A transition shape connects properly to an adjacent straight or circular arc section if the end of the shape has a point in common with the line or arc and if the shape has the same compass bearing and curvature as the line or arc at the point in common. The most prominent parameter of r(s) is normally the length of the spiral.

Approximations can be introduced to simplify equation (1) (the balance equation) and the integrals of cos(b(s)) and sin(b(s)) to obtain x and y respectively. The most common simplification replaces each cosine function by unity and each sine function by its argument expressed in radians. These simplifications will hereafter be referred to collectively as the "small angle" approximation. If the roll function is a polynomial in s and this simplification is applied, then both stages of integration called for in the KS_Method (and in the method of the current invention) can often be done in closed form so that numerical integration and iteration are not required. This simplification provides a good approximation to the extent that r(s) and b(s) are both $\leqq 0.1$ throughout the transition. Even when these two angles do not stay that small, this approximation, while not so good mathematically, may still give geometries that are effective in practice.

The method of the present invention takes advantage of the previously known principle that the axis about which the roll of the track takes place does not need to be located in the plane of the track but can be at a specified height, which height is also a parameter of the spiral.

The method of the present invention provides solutions for two existing problems in the field of railroad track transition curve geometry. One problem can arise when an existing route is being upgraded to allow operation at higher speed. If for a particular curve the speed increase is being provided for by increasing the superelevation (or banking) and without change of the radius of or path followed by the curve, then the offset between the curve and a neighboring straight section will be unchanged and the length of a standard spiral connecting them will be unchanged. The offset is the shortest distance from a circular extension of the curve to a straight extension of the straight section. It is generally necessary in such a case to find some way to lengthen the spiral. Examples of ways that traditional spirals and circular arcs have been used to address this problem in the past can be found in the article titled "Optimation of transition length increase" by Henryk Baluch, published in the October 1982 issue of Rail International.

The other problem occurs when maintenance work is being planned to adjust the alignment of an existing spiral whose shape has become deformed by passing trains. The problem is whether, and if so how, to mathematically define the shape to which the spiral should be restored. If a system is in place for measuring the location of the track relative to local fixed monuments and the original shape was mathematically defined and the existing shape has not drifted very far from the original shape, the spiral can be restored to the original design shape. When the forgoing conditions are not all met, the practice has normally been to "smooth" the alignment so that curvature measured along the corrected alignment becomes close to some form of running average of the curvature of the previous deformed alignment. Alignments created by smoothing of that kind have generally not been described by mathematical formulae. As a result, alignments have tended to drift over time.

SUMMARY OF THE INVENTION

The method of the present invention supplements and extends the KS_Method previously referred to by firstly introducing a group of new basic transition geometry shapes that are distinct from spirals and that are hereafter referred to as "bends", "jogs", and "wiggles". These new shapes induce relatively little undesirable fluctuation in dynamic responses of passing vehicles and are well suited to serve as transition curves in certain track situations. The basic shapes are characterized by the net changes of several quantities over their lengths as follows.

Traversing a spiral from end to end there is a net change in curvature. There is usually also a net change in bearing, but that is not the case when a single spiral connects symmetrical reverse curves.

Traversing a bend from end to end there is a net change in bearing angle but no net change in curvature. An example of a bend is illustrated in FIG. 1. A bend will be the best geometry for connecting two straight sections whose relative compass bearing difference is small.

Traversing from end to end a jog that is designed to provide a transition from one straight section to another straight section that is parallel thereto but offset therefrom, there is no net change in bearing angle or curvature. An example of a jog is illustrated in FIG. 2. A jog will provide good geometry for connecting two straight sections that are parallel but offset by a modest amount. A jog may provide a good geometry for a high speed crossover.

Secondly, the present invention shows that the preferred roll functions for basic spirals, bends, and jogs can be conveniently expressed in terms of the Gegenbauer orthogonal polynomials of orders 1, 2, and 3. Corresponding expressions with Gegenbauer polynomials of orders 4 and higher are taken as definitions of the roll functions of wiggles of the corresponding orders. In addition to generalization through inclusion of higher integer values of the Gegenbauer polynomial order (i.e., the lower index n), a second generalization is provided through the non-integer upper index usually denoted by lowercase Greek alpha but written herein as $(m+\frac{1}{2})$. Instead of restricting m to be an integer $\geqq 1$, it is sufficient to let m be any real value $\geqq 1$ with the value 2 a popular choice.

Thirdly, the present invention introduces the method of starting with a basic shape such as a spiral, bend, jog, or Wiggle and then augmenting its roll function by adding thereto the roll functions of one or more higher or lower order shapes, each with an adjustable coefficient, so that the original shape becomes more flexible. This method is particularly applicable for designing mathematically defined spirals with good dynamic characteristics and with shapes that do not depart as far as a basic spiral would from some existing deformed track spiral, as illustrated in FIG. 5. It is also very applicable when an existing spiral needs to be lengthened to allow for higher operating speed but it is preferred not to increase the offset for the spiral by moving the whole curve. An augmented spiral configured for this purpose is illustrated in FIG. 4.

As another example, a combination of spiral and jog roll functions with the jog function predominating can provide good geometry for a transition from one to the other of two adjacent and concentric circular alignments (e.g., a long curved section of double track) that is much shorter than the simple improved spiral connecting the two concentric alignments. Within a combination of basic roll functions based on Gegenbauer polynomials, different basic roll functions could have Gegenbauer polynomials with different values of m, but a common value of m among all the constituent basic roll functions is expected to be more popular.

Traversing a Wiggle of order 4 from end to end there is a small net change in bearing angle, there is no net change in curvature, and extensions of the adjacent sections are congruent. FIG. 3 illustrates an order 4 Wiggle calculated using an approximation one of whose consequences is that the net change in bearing angle of the Wiggle becomes zero. Generally, the roll function of a Wiggle is augmented by addition of a small bend factor times the roll function of a bend, and the bend factor is adjusted so that the augmented Wiggle has the desired zero or non zero value of net change in bearing. An order 4 Wiggle can provide good geometry when what is otherwise straight track needs to make a small lateral excursion to avoid some obstacle. An order 5 Wiggle can provide a good geometry when otherwise straight track needs to yield laterally first to one direction and then to the other in order to avoid successive obstacles on opposite sides of the track.

Fourthly, shapes similar to those described above can be obtained using the basic and augmented roll functions described above but introducing approximations, such as those which have been explained previously, to simplify equation (1) (the balance equation) and the integrals of cos(b(s)) and sin(b(s)) to obtain respectively the x and y coordinates along the transition.

Fifthly, if for one of the basic or augmented roll functions described above each Gegenbauer polynomial that appears is replaced by the finite sum of terms by which it is defined, multiplications are carried out, and terms with common powers of distance along the roll function are collected, the result will be a roll function that may seem unrelated to Gegenbauer polynomials. If such a roll function were presented as a single function rather than as a combination of the basic functions defined herein, it would still be equivalent to the roll functions disclosed herein.

THE DRAWINGS

FIGS. 1, 2, and 3 illustrate respectively a simple bend, a simple jog, and a simple Wiggle.

DESCRIPTION OF THE PREFERRED EMBODIMENTS

Figure 1:
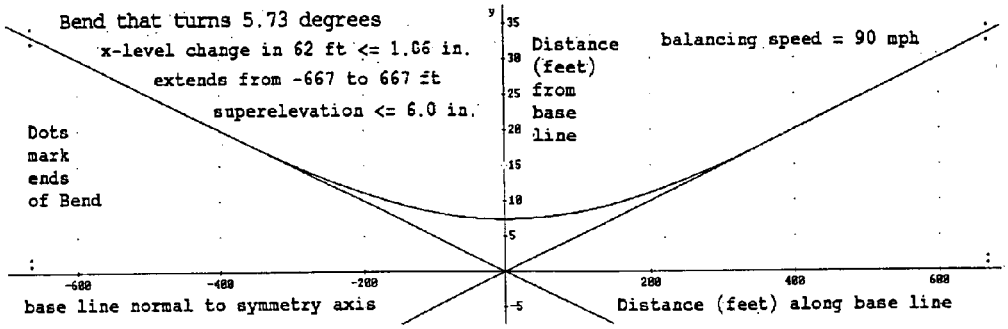

In accordance with the present invention, methods are disclosed for constructing new forms of roll functions that can be used in the KS_Method for constructing track and guide way curve transition shapes. With these new forms of roll functions the KS_Method can create spirals that are more flexible than the spiral shapes available heretofore, and it can also create transition shapes referred to as bends, jogs, and wiggles that have characteristics different from spirals and one from another, as previously described. Further, in accordance with the present invention, the "small angle" simplification method is disclosed for designing bends, jogs, and wiggles.

In a first aspect of the present invention, for defining a set of basic roll functions, a basic roll function of integer order n is defined in terms of its second derivative with respect to distance along the shape by requiring the latter to be of the form $$k_n(a^2-s^2)^{(n)}C_n^{(m+1/2)}(s/a),\ n>0 \tag{2}$$

where $C_n^a(x)$ is the standard Gegenbauer orthogonal polynomial as defined in standard references (such as Abramowitz & Stegun, "Handbook of Mathematical Functions", US Government Printing office, Washington, D.C., 1964, chapter 22), $k_n$ is an adjustable constant, a is one half the length of the transition shape, s is distance along the shape relative to the midpoint thereof, and m is a not necessarily integer value $\geqq 1$. The value for m that is expected to be most useful is m=2. However, values such as m=1.5, 2.5, and 3 could also give usable shapes. It is not necessary that m be half integral, but when it is not $C_n^{(m+1/2)}(s/a)$ will include non integral powers of x so that algebra will be more complex.

The expressions for roll angle versus distance obtained by integrating equation (2) two times with respect to s takes the form $$j_1(\text{integral on } t \text{ from} -a \text{ to } s \text{ of } (a^2-t^2)^{(m+2)}) \tag{3}$$

when n=1, and the form $$j_n(a^2-s^2)^{(m+2)}C_{n-2}^{(m+5/2)}(s/a),\ n>1 \tag{4}$$

when n>1, where $j_n$ is a new constant coefficient. The integral of equation (3) can be obtained in closed form when m is half integral. For example, for m=2 one finds that expression (3) for the roll angle versus distance takes the form $$j_1(a+s)^4(16\ a^3-29a^2s+20\ a\ s^2-5s^3) \tag{5}$$

where $j_1$ has been redefined.

In a second aspect of the present invention, for forming roll functions to be used in the KS_Method, basic roll functions of orders 1, 2, 3, 4, . . . can be used either by themselves or in linear combinations, where the term "linear combination" means the sum of a set of contributions each of which has its own coefficient. A roll function that is a linear combination of basic roll functions with a common value of m is identified by an order symbol such as {m; 0.0, 1.0, 0.5} in which the comma separated values following the semicolon indicate the values of the $j_n$ coefficients for the basic shapes of orders 1, 2, 3, 4, . . . relative to the (normally unique) $j_n$ that is =1.0. A basic roll function should be considered to include its coefficient when the basic roll function is referred to without mention of its coefficient. Several examples of uses for linear combinations with more than one basic roll function have previously been described.

The basic roll functions of orders 2 and 3 generate bends and jogs respectively. As previously explained, the order 4 roll function will generate a typical Wiggle by itself if the calculations are done after making the "small angle" simplifications. When those simplifications are not made, a Wiggle will typically need to have an order such as {2; 0, 0.01, 0.0, 1.0} where the coefficient for the small bend component is adjusted so that the net change in compass bearing over the length of the Wiggle is zero.

When methods of this invention are being used to construct a roll function for a spiral that is augmented by an addition of bend and/or other higher order components, it is preferred to use the KS_Method without application of the "small-angle" simplifications.

In a third aspect of the present invention the "small angle" simplifications are applied within the KS_Method so that the latter becomes easier to use for the design of bends, jogs, and wiggles. When the methods of this invention are being used to construct a roll function for a bend, a jog, or a Wiggle that is being fitted to a practical situation, compass bearing values will often be limited to a range small enough so that, with a suitable choice of axes, it may be satisfactory to apply the "small angle" simplifications within the KS_Method. When that is the case, integration of balance equation (1) to obtain b(s) and integration of the cosine and sine thereof to obtain respectively the x and y coordinates along the shape can be carried out in closed form. The values that $j_n$ and a must take in order for the shape to make the desired transition can then also be found in closed form so that the computational procedure is simplified. Application of the "small angle" simplification in this way is explained below for the case of a bend. Differences that apply when working out analogous results for a jog and a Wiggle are indicated. Details can be reproduced by one skilled in the art. When deriving the relevant formulae it is helpful to use any one of a variety of known symbolic mathematics computer programs (such as Derive, Mathematica, or Maple). If this simplified treatment is used in practice, one must be aware that the relationship between curvature and superelevation is slightly different than normal and may need to take account of that when choosing the balance speed v to be used in the design.

For a simple bend with m=2, expression (4) gives $$r(s)=k(a^2-s^2)^4 \tag{6}$$

where k is a constant to be determined. Working in the coordinate system illustrated in FIG. 1, x, which is the integral of unity from zero to s becomes simply s, meaning that s is not longer the distance along the bend but rather the x coordinate. With the "small angle" simplification b(s) ceases to be the bearing angle and becomes instead the tangent thereof (hereafter written as bt(s) as a reminder). The integral of the simplified form of balance equation (1) is found to give $$bt(x)=gkx(315a^8-420a^6x^2+378a^4x^4-180a^2x^6+35x^8)/(315v^2) \tag{7}$$

The y coordinate y(x) as a function of x is the integral of bt(x) from −a to x.

Carrying out the integration without regard to the constant of integration one obtains $$y(x)=-gk(193a^{10}-315a^8x^2+210a^6x^4-126a^4x^6+45a^2x^8-7x^{10})/(630v^2)$$

With the lower limit of the forgoing integration at −a, y(x) of formula (8) will be zero at each end of the bend. It is necessary to add to that result the actual height of the two ends of the bend, namely $$a\ \tan(\text{turn}/2) \tag{9}$$

where turn denotes the bearing angle difference between the straight sections connected by the bend. The track is displaced downward from the path of the roll axis by the overhang which is $$h\ \sin(r(x)) \tag{10}$$

where h denotes the height of the roll axis above the plane of the track. Thus the formula for the y coordinate of the track is $$y_track(x)=y(x)+a\ \tan(turn/2)-h\ \sin(r(x)) \quad (11)$$

The primary constraint is that the bend turn by the correct amount. This constraint has the form $$bt(x)=\tan(turn/2) \quad (12)$$

so that the constant k must be set to $$k=315v^2\ \tan(turn/2)/(128a^9g) \quad (13)$$

There are two secondary constraints both of which place lower limits on the value of the half length a. One is that the roll angle of the track not exceed the maximum allowed value denoted max_roll. The maximum roll occurs at the center of the bend, and this constraint takes the form $$a_roll_lim=315v^2\ \tan(turn/2)/(128g\ max_roll) \quad (14)$$

where a_roll_lim is the first lower limit on a. The other secondary constraint is that the derivative of the roll angle with respect to distance not exceed the maximum allowed value denoted max_r_veloc. The maximum value of dr(x)/dx occurs for $x=-a/\sqrt{7}$ and this constraints takes the form $$a_twist_lim=9(308700)^{1/4}v\ (\tan(turn/2))^{1/2}/(98(g\ max_r_veloc)^{1/2}) \quad (15)$$

where a_twist_lim is the other lower limit on the half length.

In this simplified treatment the distance along the bend as a function of x is obtained by numerical integration of the expression $$1/(\cos(\arctan(bt(x))-\arctan(h\ \cos(r(x))dr/dx))) \quad (16)$$

and the actual length along the bend will be a little greater than 2 a.

When applying the "small-angle" simplification to the case of a jog or a Wiggle the formulae for bt(x) and y(x) are obtained as above but based on the formula for r(s) appropriate to the shape.

Figure 2:
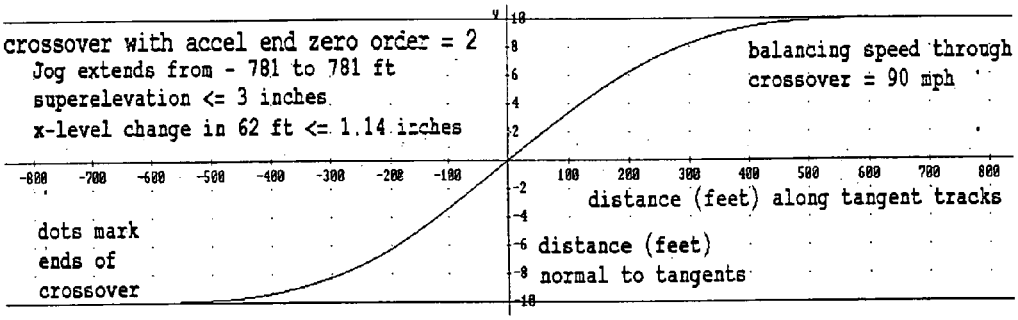

Looking at the case of a jog and using the coordinate system illustrated in FIG. 2, the lower limit in the integration to obtain y(x) is conveniently taken to be zero. The primary constraint is that the lateral displacement over the length of the jog, denoted jog_dist, should equal the specified distance between the parallel straight sections (or extensions thereof) to which the jog connects. As in the case of the bend, the secondary constraints are that the roll angle and twist of the track should nowhere exceed the respective limits chosen for those two properties. The maximum values of roll angle and of roll velocity occur at x=a/3 and x=0 respectively. The lower limits on the half length of the jog are found to be $$a_roll_lim=4(1155jog_dist)^{1/2}v/(81(g\ max_roll)^{1/2}) \quad (17)$$

and $$a_twist_lim=(6930jog_dist\ v^2)^{1/3}/(8(g\ max_r_veloc)^{1/3}) \quad (18)$$

Figure 3:
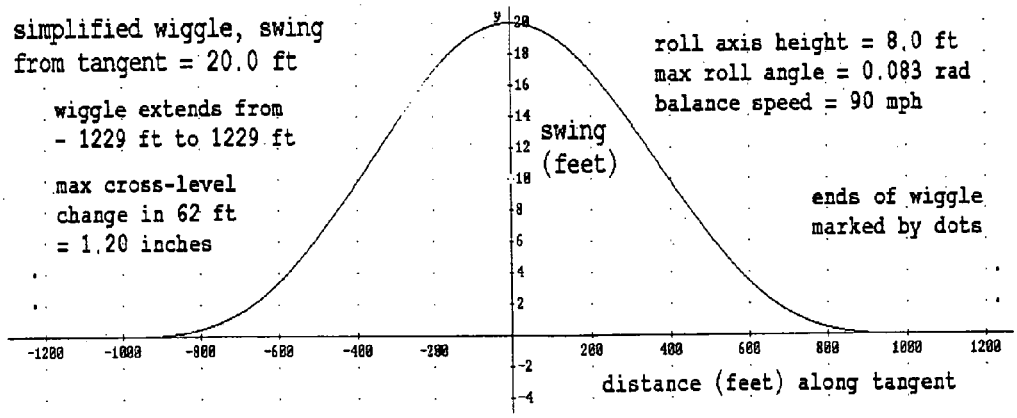
Figure 4:
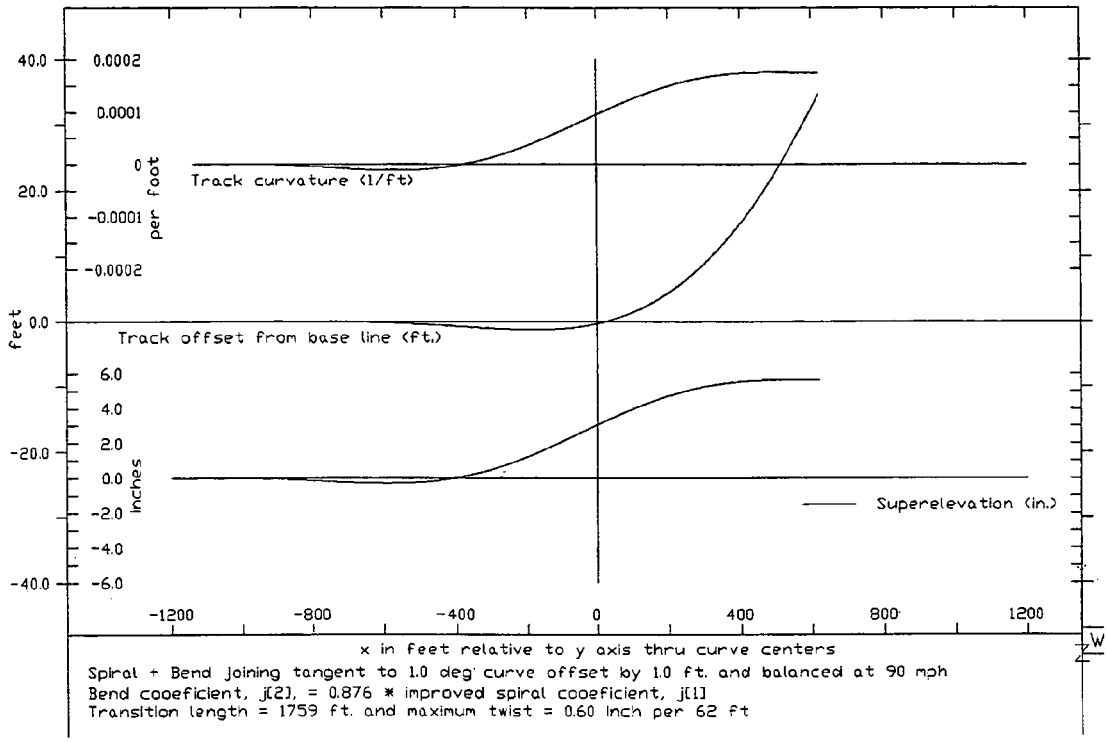
FIG. 4 illustrates a spiral augmented with a bend component.
Figure 5:
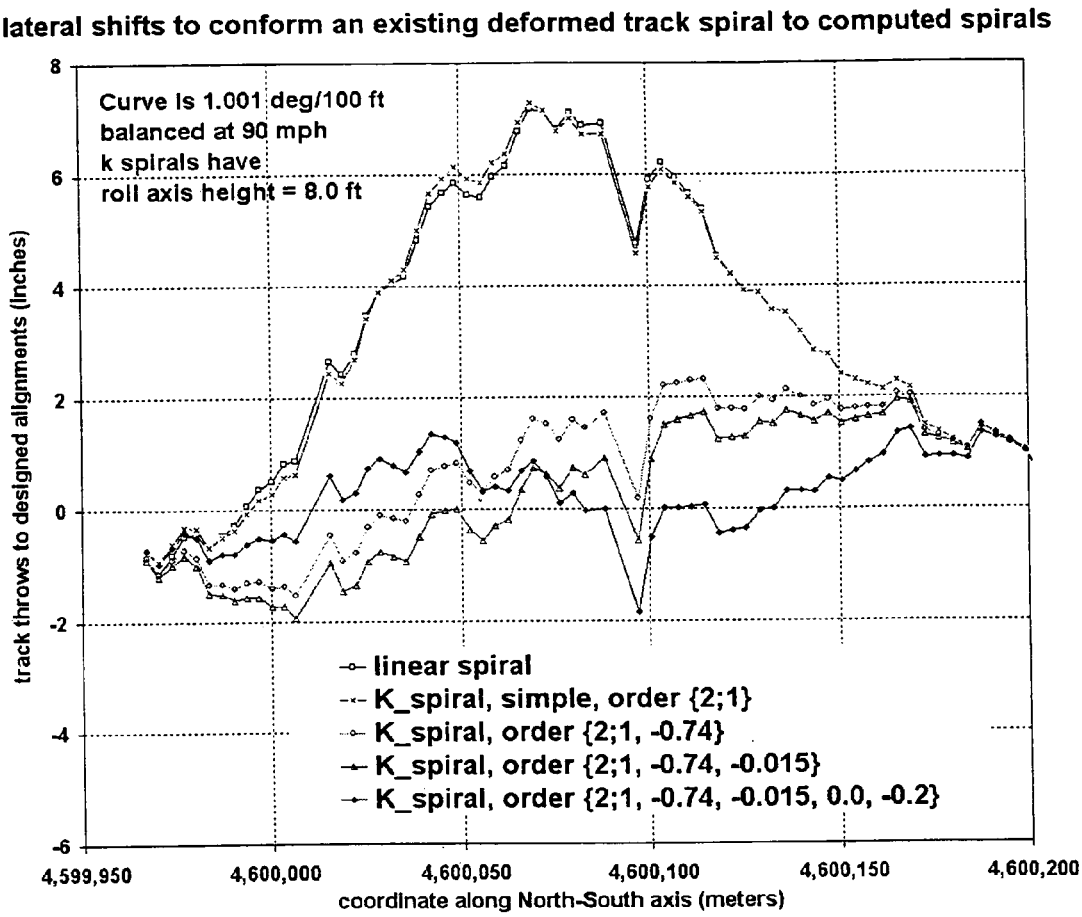
FIG. 5 illustrates a spiral augmented by various combinations of higher.

In the application of the "small-angle" simplification to the case of a Wiggle that makes an excursion to a distance swing_dist away from a straight line and then returns to that line, and using the coordinate system illustrated in FIG. 3, it is found that y(x) is proportional to $(g/v^2)(a^2-x^2)^6$. Consistent with the "small-angle" simplification the sine function is dropped from formula (10) above for the overhang. The distance from the straight line to the track is greatest at the center of the Wiggle where that distance is y(0)+h r(0). The primary constraint is that the maximum excursion of the Wiggle from the straight line must equal swing_dist. Applying that constraint determines the coefficient $j_4$ of equation (4). Applying the secondary constraints one finds that $$a_roll_lim=2(3h\ max_roll+3swing_dist)^{1/2}v/(g\ max_roll)^{1/2} \quad (19)$$

and $$a_twist_lim=-4i(h/g)^{1/2}v\ \sin(theta/3) \quad (20)$$

where i is the square root of −1, and $$theta=\arcsin(i(hg)^{1/2}swing_dist\ NC/(h^2\ max_{13}\ r_{13}\ veloc\ v)) \quad (21)$$

where $$NC=(1517158400(3)^{1/2}/526153617+454246400/58461513)^{1/2} \quad (22)$$

The forgoing expressions for a_twist_lin are from solution of a cubic equation They can be evaluated easily using a known symbolic math program such as Derive.

I claim:

1. A machine-implemented method for constructing a roll function for use in designing transition curves for railroad tracks and other vehicle guideways, wherein the designing of the transition curves requires the roll function to be supplied and wherein the method comprises the steps of:

defining a set of basic roll functions;

constructing the roll function as a linear combination of at least one of the basic roll functions while treating coefficients of an individual basic roll function as parameters of the roll function and considering the individual basic roll function to include a coefficient when the individual basic roll function is referred to without mention of the coefficient; and shaping and superelevating said railroad tracks and other vehicle guideways in accordance with the roll function.

2. A method according to claim 1 wherein the roll function is used in a $KS_{13}$ Method for designing a transition shape and wherein the method further includes the steps of:

choosing a basic roll function which specifies a variation of guideway roll angle as a function of distance and of adjustable parameters;

causing centripetal and gravitational acceleration components in a plane defined by the guideway to be approximately equal at each point along a transition between two adjacent sections of the guideway by requiring curvature of alignment to approximately satisfy a balance equation;

determining a resulting transition curve alignment for given values of adjustable parameters by integrating the balance equation to obtain a compass bearing of the transition shape as a function of distance and by then integrating the cosine and the sine of the compass bearing to obtain respectively x and y coordinates of points along the transition shape, thereby defining a computed shape;

determining parameter values for which the computed shape connects with the two adjacent sections off the guideway; and repeating integrations in each iteration of an iterative search.

3. A method according to claim 1 which further includes the step of defining the basic roll functions via second derivatives of roll angle with respect to distance and in terms of standard Gegenbauer orthogonal polynomials $C_n^a$ (x) by the formula $$d^2r(s)/ds^2=j_n(a^2-s^2)^m C_n^{(m+1/2)}(s/a)$$

where a is an integer ≧1, m is a real value ≧1.0, a is one half the length of the transition, s is a distance along the transition measured relative to a midpoint of the transition, r(s) is the roll angle as a function of distance s, and $j_n$ is a constant, and wherein the basic roll functions are not defined as a linear combination of a single basic roll function where n=1.

4. A method according to claim 2 which further includes the step of defining the basic roll functions via second derivatives of roll angle with respect to distance and in terms of standard Gegenabauer orthogonal polynomials $C_n^a$ (x) by the formula $$d^2r(s)/ds^2=j_n(a^2-s^2)^m C_n^{(m+1/2)}(s/a)$$

where n is an integer ≧1, m is a real value ≧1.0, a is one half the length of the transition, s is a distance along the transition measured relative to a midpoint of the transition, r(s) is the roll angle as a function of distance s, and $j_n$ is a constant, and wherein the basic roll functions are not defined as a linear combination of a single basic roll function where n=1.

5. A method according to claim 4 wherein m is a real value selected from the group of values consisting essentially of 1.0, 1.5, 2.0, 2.5 and 3.0.

6. A method according to any one of claims 1 to 5 for designing a generalized spiral transition and further comprising the step of choosing a linear combination of the basic roll functions that includes more than one basic roll function and so that a net change in roll angle over the length of the transition is non zero.

7. A method according to claim 6 which further includes the step of adjusting the parameters of the generalized spiral so that the spiral connects from a straight section of the guideway to a curved section of the guideway, and after leaving the straight section, first moves away from the curved section and then reverses curvature to join the curved section, whereby the generalized spiral can be made longer than a traditional spiral without being restricted by a lack of adequate offset between neighboring guideway sections.

8. A method according to claim 6 which further includes the step of adjusting the parameters of the generalized spiral so that the spiral connects from one section of the guideway to another section of the guideway and so that compared to a corresponding simple spiral the shape of the generalized spiral lies closer to an existing guideway transition having an alignment requiring improvement.

9. A method according to claim 6 which further includes the step of adjusting the parameters of the generalized spiral so that the generalized, spiral connects from one section of the guideway to another section of the guideway and so that the generalized spiral is shaped to avoid a local obstruction.

10. A method according to any one of claims 1 to 5 for designing a bend transition and further comprising the steps of:

choosing a linear combination of the basic roll functions that includes at least one of the basic roll functions and so that a net change in roll angle over the length of the transition is zero; and choosing the basic roll functions so that the bend provides a transition between two sections of the guideway which are both straight and not parallel with each other.

11. A method according to any one of claims 1 to 5 for designing a bend transition and further comprising the steps of:

choosing a linear combination of the basic roll functions that includes at least one of the basic roll functions and so that a net change in roll angle over the length of the transition is zero; and choosing the basic roll functions so that the bend provides a transition between two sections of the guideway which are both circular arcs of identical radius with distinct centers and so that a line through centers of the two sections of the guideway is parallel to a line through two ends of the bend.

12. A method according to any one of claims 1 to 5 for designing a jog transition and further comprising the steps of:

choosing a linear combination of the basic roll functions that includes at least one of the basic roll functions and so that a net change in roll angle over the length of the transition is zero; and choosing the basic roll functions so that the jog provides a transition between two sections of the guideway which are both straight and parallel but not collinear.

13. A method according to claim 12 which further includes the step of adjusting parameters of the jog so that the jog defines a shape of at least a majority of a length of a crossover between two sections of the guideway that run side-by-side in a two track configuration and that are both straight and parallel.

14. A method according to any one of claims 1 to 5 for designing a jog transition and further comprising the steps of:

choosing a linear combination of the basic roll functions that includes at least one of the basic roll functions and so that a net change in roll angle over the length of the transition is substantially zero; and choosing the basic roll functions so that the jog provides a transition between two sections of the guideway which are both circular arcs of substantially identical radius and that are substantially concentric.

15. A method according to claim 14 which further includes the step of adjusting parameters of the jog so that the jog defines a shape of at least a majority of a length of a crossover between two sections of the guideway that run side-by-side in a two track configuration and that are both circular arcs with radii that are substantially equal.

16. A method according to any one of claims 1 to 5 for designing a wiggle transition and further comprising the steps of:

choosing a linear combination of the basic roll functions that includes at least one of the basic roll functions and so that a net change in roll angle over the length of the transition is zero; and choosing the basic roll functions so that if one end of a resulting transition alignment connects to a particular straight line, then another end of the resulting transition alignment connects to a location on the same straight line, and so that the wiggle enables an otherwise straight section to circumvent a local obstacle.

17. A method according to any one of claims 1 to 5 for designing a wiggle transition and further comprising the steps of:

choosing a linear combination of the basic roll functions that includes at least one of the basic roll functions and so that a net change in roll angle over the length of the transition is zero; and choosing the basic roll functions so that if one end of a resulting transition alignment connects to a particular arc, then another end of the resulting transition alignment connects to a location on the same arc, and so that the wiggle enables an otherwise uniformly curved section to circumvent a local obstacle.

* * * * *